US006682571B2

(12) United States Patent
Kunitou et al.

(10) Patent No.: US 6,682,571 B2
(45) Date of Patent: Jan. 27, 2004

(54) PROCESS FOR MAKING PATTERN ON DYED FABRIC AND DYED FABRIC OBTAINED BY THE PROCESS

(75) Inventors: Katsushi Kunitou, Okayama (JP); Setsuaki Hongyou, Okayama (JP); Shingo Maeda, Okayama (JP); Kazuhiro Sayama, Tsukuba (JP); Hironori Arakawa, Tsukuba (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 7 days.

(21) Appl. No.: 10/026,262

(22) Filed: Dec. 20, 2001

(65) Prior Publication Data

US 2002/0120990 A1 Sep. 5, 2002

(30) Foreign Application Priority Data

Dec. 27, 2000 (JP) ..... 2000-398637

(51) Int. Cl.[7] ..... D06P 5/20; D06P 5/15; D06L 3/00

(52) U.S. Cl. ..... 8/102; 8/103; 8/115.52; 8/444

(58) Field of Search ..... 8/115.52, 102, 8/103, 444

(56) References Cited

U.S. PATENT DOCUMENTS

| | | | |
|---|---|---|---|
| 1,933,810 A | | 11/1933 | Keyton et al. |
| 2,430,254 A | * | 11/1947 | Solomon |
| 3,145,156 A | * | 8/1964 | Oster |

FOREIGN PATENT DOCUMENTS

| | | |
|---|---|---|
| FR | 675 838 | 2/1930 |
| GB | 875 364 | 8/1961 |
| JP | H6-17381 | 1/1994 |
| JP | H6-207386 | 7/1994 |
| JP | H7-97785 | 4/1995 |
| JP | H9-13287 | 1/1997 |
| JP | H9-228266 | 9/1997 |
| JP | 09 228266 | 9/1997 |
| JP | H10-102386 | 4/1998 |

* cited by examiner

*Primary Examiner*—Margaret Einsmann
(74) *Attorney, Agent, or Firm*—Koda & Androlia

(57) ABSTRACT

A process for making a pattern according to intended design on cloth or clothing, particularly denim clothing, dyed with a colorant or a dye through decolorizing is provided. Fabric or clothing dyed with a colorant or a dye is impregnated with a substance forming an oxidized active species upon electrolysis and inserted between a pair of electrodes, and electricity is applied to the electrodes, whereby only a part where electricity is applied is selectively decolorized to make a pattern with gradated effect.

10 Claims, 3 Drawing Sheets

PROCESS FOR MAKING PATTERN ON DYED FABRIC AND DYED FABRIC OBTAINED BY THE PROCESS

BACKGROUND OF THE INVENTION

1. Field of the Invention

The present invention relates to a process for making a pattern on fabric, such as cloth and clothing, dyed with a colorant or a dye through decolorizing, discoloring, or bleaching. And more particularly, it relates to a process for easily producing an intended pattern on dyed fabric or colored clothing, particularly denim clothing such as Jeans. The invention also relates to an apparatus using in the process. Further, the invention also relates to dyed fabric having a pattern and colored clothing having a pattern that are produced by the process.

2. Description of the Related Art

As one of techniques for improving the fashion value of textile products, such a method has been carried out that a part of dyed cloth or clothing is decolorizing to make a pattern. In particular, because there is a tendency in denim clothing that partially decolorized products have the preference, processing technology for making a pattern has been particularly advanced, and various processes have been proposed. For example, a stone wash method and a sand blast method of applying physical impacts to fabric, and a chemical wash method of chemically decomposing the dye by using a reagent, such as sodium hypochlorite, have been industrially and widely used as general methods.

While these methods are effective as a process for decolorizing the whole or a wide area of denim clothing, it is very difficult to make an intended pattern of figures and letters on a specified part thereof, and a large-sized equipment is required. A printing method has been used for making an intended pattern. In this method, a pattern mold shaped in a negative image of the intended pattern is plated on dyed fabric, and a paste containing a reagent, such as sodium hypochlorite, is then printed thereon, whereby a dye on the part where the paste is attached is decolorized to make the pattern.

Other examples of the method for making an intended pattern of figures and letters on denim clothing include a method using a laser (Japanese Patent Laid-Open No. 102386/1998) and a method, in which dyed fabric is further dyed with a mordant dye, and then the mordant dye on an intended part is discharged (Japanese Patent Laid-Open No. 13287/1997). What are disclosed with respect to dyed cloth include a method, in which a pattern mold is placed on dyed fabric, and particles are blown thereon (Japanese Patent Laid-Open No. 17381/1994), a method using an ultraviolet ray (Japanese Patent Laid-Open No. 207386/1994), a method using ozone (Japanese Patent No. 2,864,110 or Japanese Patent Laid-open No. 228266/1997) and a method using microorganisms (Japanese Patent Laid-Open No. 97785/1995).

However, the conventional methods for making an intended pattern of figures and letters have the following problems. In the printing method, which is a decolorizing method by application of a paste, it is necessary that the paste is dried after application and is finally removed. It also requires complicated processing steps, for example, steaming is necessarily carried out on the decolorizing step. Furthermore, since water is used to remove the paste, such a problem arises that a large amount of wastewater containing the paste is formed.

The foregoing methods for solving the problems of the printing method also have problems. In the methods using a laser or an ultraviolet ray, a large-sized equipment is required for irradiation of light, and there is a possibility that safety of the working environment is jeopardized by irradiation of a laser light beam or an ultraviolet ray. In the method where a mordant dye is discharged, such a step is required that dyed cloth or clothing is further dyed with a mordant dye, and thus complicated operation is necessarily added as a method for making a pattern. In the method using particles, fibers of the fabric are liable to be damaged, and there is a possibility of deterioration of the working environment due to flying of powder caused by blowing particles. In the method using ozone, such considerably complicated equipment and operations are required that the processing is necessarily carried out in an airtight vessel due to the use of harmful ozone, and an equipment for removing remaining ozone is necessary. In the method using microorganisms, such considerably complicated operations requiring a long period of time are necessary that the operations are necessarily carried out under temperature conditions, at which the microorganisms are grown, and the operations take several hours.

Upon considering the diversification of demands of the consumer, such a process is demanded that can easily and quickly make a pattern, but most of the processes having been proposed are those requiring particular processing steps or equipments for decolorizing, and thus no simple process has been practiced.

SUMMARY OF THE INVENTION

As a result of earnest investigations made by the inventors taking the foregoing problems into consideration, the invention has been completed. An object of the invention is to provide a process for intentionally making a pattern of figures and letters by decolorizing dyed cloth or clothing in a short period of time without forming a large amount of waste water, without causing deterioration of the working environment, and without using any further particular processing step or processing equipment.

The invention relates to a process for producing a pattern on dyed fabric by decolorization, discoloration or change of color (which is sometimes simply referred to as bleaching). Specifically, the invention relates to a process for making a pattern on dyed fabric containing the steps of: impregnating dyed fabric with a substance forming an oxidized active species upon electrolysis (hereinafter, the substance is sometimes referred to as an electron carrier); inserting the dyed fabric between a pair of electrodes; and applying electricity to the electrodes, whereby only a part of the dyed fabric where electricity is applied is selectively subjected to decolorization, discoloration or change of color.

In a part where no electricity is applied, no oxidized active species is formed from the electron carrier. Therefore, a pattern of figures and letters can be arbitrarily made by specifying the part where electricity is applied.

It is possible that at least one of the pair of electrodes is an electrode shaped in a positive image of the pattern. At this time, an anode shaped in a positive image of the pattern is preferably used. In the part other than the electrode shaped in a positive image of the pattern, no oxidized active species is formed, and decolorization, discoloration or change of color does not occur.

It is also possible upon applying electricity that an electro-nonconductive film or an electro-nonconductive spacer shaped in a negative image of the pattern is inserted between the electrode and the dyed fabric. At this time, the film or the spacer is preferably inserted between an anode and the dyed fabric. In this configuration, even when the electrodes are in a form of a simple plate, the pattern is formed by decolorization, discoloration or change of color caused by following the outer shape and the negative image of the pattern of the electro-nonconductive film or the electro-nonconductive spacer inserted between the electrode and the dyed fabric.

The invention is also an apparatus with the above-mentioned process for making pattern. Further, this invention relates to dyed fabric having a pattern and colored clothing having a pattern that are produced by the process.

DESCRIPTION OF THE PREFERRED EMBODIMENTS

Figure 1:
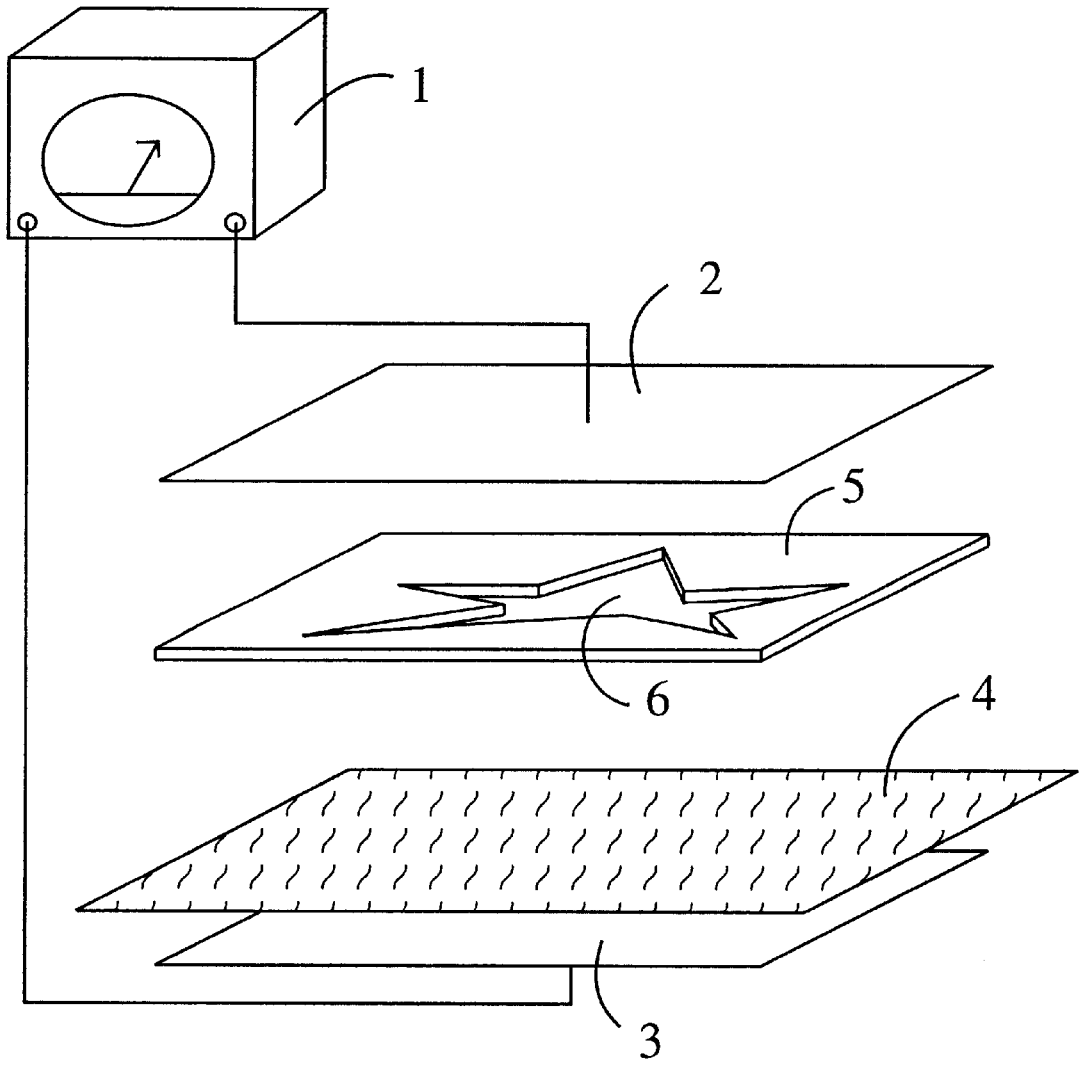
FIG. 1 is a perspective view showing an embodiment of the process for making a pattern according to the invention.
Figure 2:
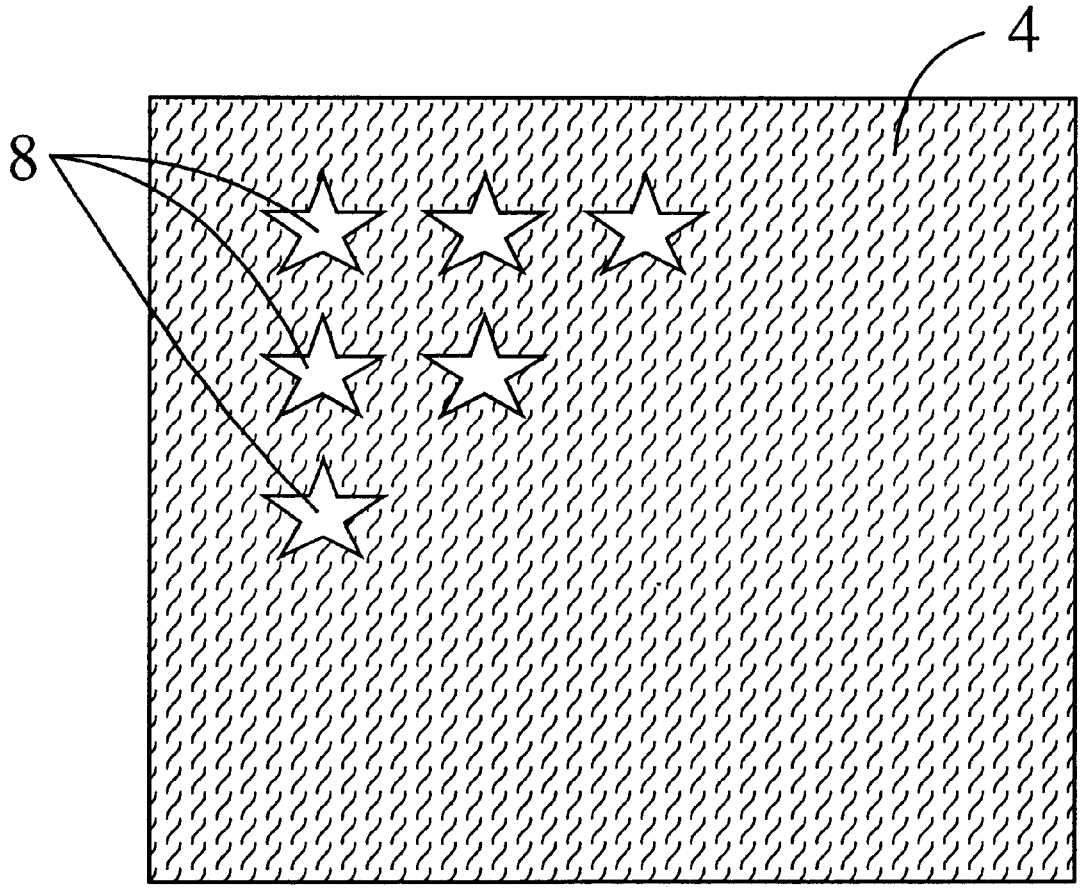
FIG. 2 is a plane view showing an embodiment of a pattern on dyed fabric.
Figure 3:
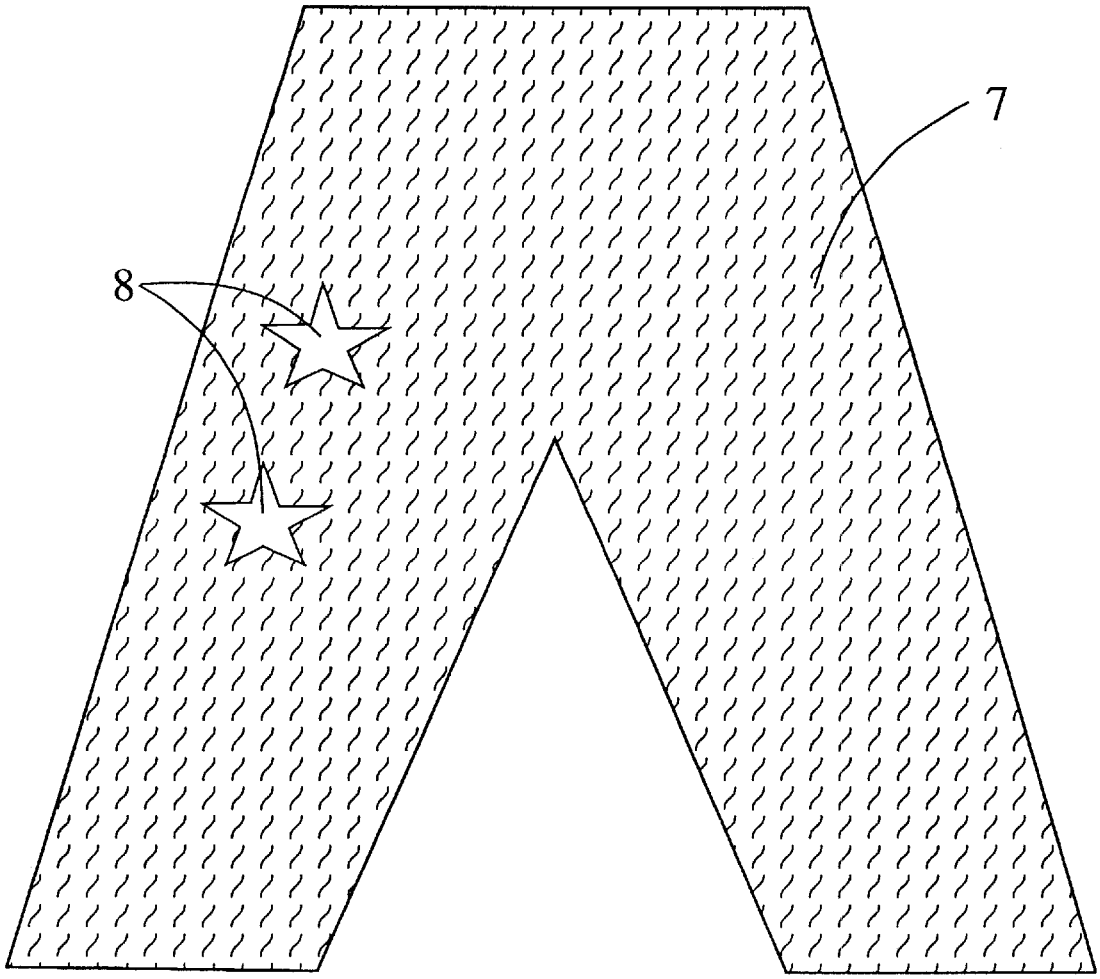
FIG. 3 is a plane view showing trousers as colored clothing having a pattern formed thereon.

The process for making a pattern on dyed cloth or colored clothing as an embodiment of the process for making a pattern on dyed fabric according to the invention will be described with reference to the drawings. FIG. 1 is a perspective view showing the process for making a pattern according to the invention. FIG. 2 is a plane view showing a pattern on dyed fabric. FIG. 3 is a plane view showing trousers as colored clothing having a pattern formed thereon. In FIG. 1, a voltage is applied between an anode 2 and a cathode 3 by a constant current generator 1. Dyed fabric 4 impregnated with an electron carrier and an electro-nonconductive film 5 are inserted between the anode 2 and the cathode 3. The electro-nonconductive film 5 has a cut part 6 shaped in a pattern, and the dye in the cut part is decolorized to form patterns 8 through decolorizing a part of the dyed fabric 4 or clothing 7 as shown in FIGS. 2 and 3.

The form of the dyed fabric used in the invention is not particularly limited, and any form thereof can be used. For example, fabric in the form of cloth and that in the form of clothing can be used in the process of the invention. Examples of the materials for the cloth and the clothing include natural fibers, such as cotton, wool, silk and linen, semi-synthetic fibers, such as rayon and acetate, and synthetic fibers, such as polyesters, polyamides, polyacrylonitriles and aromatic polyamides. Cloth, sewn products, knitted products and non-woven cloth formed with single fibers or mixed fibers of the materials are also included. Examples of the dye for dyeing the fabric include direct dyes, acidic dyes, basic dyes, mordant dyes, acidic mordant dyes, metal-containing complex dyes, sulfide dyes, naphthol dyes, disperse dyes, reactive dyes, cationic dyes, vat dyes and fluorescent dyes. Various kinds of colorants may also be used as the dye.

When dyed cloth or clothing impregnated with the electron carrier is inserted between the electrodes, to which electricity is applied, an oxidized active species is formed from the anode. decolorizing is carried out by using the oxidized active species. As the oxidized active species used herein, hypochlorous acid formed through electrolysis of sodium chloride can be applied, but any electron carrier can be used irrespective to organic substances and inorganic substances as far as it forms from the anode through electrolysis not only hypochlorous acid but any oxidized active species capable of decomposing the dye. Examples thereof include halogen-containing salts containing halide ion, such as chloride ion, bromide ion and iodide ion, or containing hypochlorite ion; transition metal salts containing metallic ion, such as cerium ion and manganese ion; and organic compounds, such as tertiary amines, sulfides and phenothiazines. In those of examples, halogen-containing salts are preferable. Further, the material containing halide ion, especially chloride ion, is more preferable. Furthermore, sodium chloride is most preferable. Sodium bromide and sodium hypochlorite are also used preferably.

Any material that transmits electricity and forms a stable electrode can be basically used as the electrode material. While the electrode material is necessarily selected depending on the kind of the electron carrier, those electrodes that have been considered in the industrial electrolytic process of sodium chloride can be used in the case where sodium chloride is used as the electron carrier. Usable examples of the anode include platinum, carbon, titanium, titanium carrying ruthenium oxide, an anti-corrosion alloy, and an electroconductive metallic oxide, such as tin oxide. Usable examples of the cathode include platinum, carbon, iron, stainless steel, nickel, and an electroconductive metallic oxide, such as tin oxide.

The concentration of the solution containing the electron carrier may be any range as far as electricity can be turned on. When the concentration is too small, the resistance between the both of electrodes is increased to cause a problem in that generation of the oxide active species becomes unstable. When the concentration is too large, the oxidized active species is generated as concentrated at a part of the electrode to cause a problem that uniform decolorizing cannot be achieved. Therefore, in the case where sodium chloride is used as the electron carrier, the concentration may be from 0.1 g/L to the saturated concentration, and a preferred range of the concentration where no decolorizing unevenness occurs is from 0.1 to 10 g/L.

The amount of the solution containing the electron carrier may be such an amount that the cloth is impregnated. When the amount of the solution is too small, the resistance between both of the electrodes is increased to cause a problem in that generation of the oxide active species becomes unstable. Therefore, the amount of the solution is preferably from 100% to the saturated water content. In the case where the solution is vaporized during the process, water or solution containing the electron carrier is supplied.

The amount of electrification may be about several $mA/cm^2$, and when the area of electrification is about 25 $cm^2$, constant current generator of several hundreds mA can be used. The processing time can be adjusted by the amount of electrification, and when 100 mA is applied to an area of about 25 $cm^2$, the processing time may be about from 1 to 10 minutes. The degree of decolorizing can be arbitrarily achieved by controlling the amount of electrification and the processing time.

The pattern can be made with an anode shaped in a positive image of the pattern, such as an anode shaped in a pattern and an anode with a pattern stamped by cutting a part of the anode. According to the configuration, such a pattern can be obtained that is formed by decolorizing in the shape of the anode. In the case where the anode is in a form of a simple plate, the pattern can be similarly made by using an electro-nonconductive frame, such as a film and a spacer, shaped in a negative image of the pattern inserted between the cloth or clothing and the anode. According to the configuration, such a pattern can be obtained that decolorizing does not occur in the shape of the frame.

The frame is preferably formed with an electro-nonconductive material solely or in combination of plural kinds thereof. Examples thereof include plastics, rubber, glass and ceramics. An electroconductive material, such as metals, can also be used as the frame after coating the surface thereof with the electro-nonconductive material.

Protons are consumed on the cathode, to become surroundings of the cathode alkaline. When unfavorable influences occur thereby, the pH can be controlled by inserting an ion exchange film between the fabric and the cathode.

A sharp pattern can be formed by making the electrodes and the fabric in close contact with each other. A pattern with a blurry contour can also be formed by loosing the contact between the fabric and the anode or by inserting a porous spacer impregnated with the electron carrier between the fabric and the anode. The electro-nonconductive frame may not be in one united body, and for example, a frosting pattern can be made by inserting sand.

According to the process of the invention, because a pattern can be easily and simply made by decolorizing, an arbitrary pattern can be made by the consumers after purchase of the product, and a pattern can be made at retail stores as services. The apparatus using in the process of the invention comprises at least a pair of electrodes. The consumers can also make a pattern by themselves by using a kit as the apparatus utilizing the invention. Containing a electric source, such as a constant current generator, to the kit is also utilized in addition to the electrodes mentioned above. Moreover, the electrodes being shaped in a pattern is also desirable. Further, in addition to the electrodes, it is also preferable that a kit is comprising an electro-nonconductive film or an electro-nonconductive spacer shaped in the pattern. It makes for the consumers to be able to produce easily a desirable shape in the pattern by themselves. As shown in above description, it is considered that the process of the invention exerts high industrial value that patterns that supports the needs of the consumers are immediately provided.

The invention will be further described in detail with reference to the following examples and comparative examples. In the examples and comparative examples, the amount of decolorizing was measured and evaluated in the following manner. A sample having been sufficiently washed with water after applying electricity was measured for reflectance by a color measurement system (AUCOLOR-NF, produced by Kurabo Industries, Ltd.), and it was converted to a Kubelka-Munk function over the entire wavelength (interval: 20 nm), so as to evaluate the total K/S.

EXAMPLE 1

Denim cloth dyed with indigo (cotton twill fabric, warp thread density: 65 per inch, apparent yarn number: 7; weft thread density: 44 per inch, apparent yarn number: 8; total K/S: 431.78) impregnated with a sodium chloride solution of 10 g/L and a plastic film formed with polyester (thickness: 0.1 mm) were inserted between electrodes (fluorine-coated tin oxide thin film electrodes, resistance: 15 Ω, dimension: 5×5 cm) The plastic film was placed on a lower half of the area, on which electricity was to be applied, between the anode and the cloth. Electricity was applied with an electric current of 100 mA for 7 minutes, and as a result, a part of the cloth having no film placed thereon was selectively decolorized. After application of electricity, the cloth was washed with water to remove remaining oxidized active species and then sufficiently dried. The resulting denim cloth was measured for the total K/S. The results obtained are shown in the lowermost lines of Tables 1 and 2 below.

EXAMPLE 2

The same procedures as in Example 1 with the same conditions for the electrification were carried out except that the processing time was changed to 3 and 5 minutes, and the total K/S was measured. The results obtained are shown in Table 1. The degree of decolorizing is increased corresponding to the processing time, and thus the extent of decolorizing can be easily adjusted by the electrification time.

TABLE 1

| | Total K/S | Degree of decolorizing (%) |
|---|---|---|
| Without electrification | 431.78 | |
| 100 mA, 3 min.processed | 59.87 | 86.1 |
| 100 mA, 5 min.processed | 39.59 | 90.8 |
| 100 mA, 7 min.processed | 24.69 | 94.3 |

EXAMPLE 3

The same procedures as in Example 1 with the same conditions for the electrification were carried out except that the electric current was changed to 40 and 60 mA, and the total K/S was measured. The results obtained are shown in Table 2. The degree of decolorizing is increased corresponding to the electric current, and thus the extent of decolorizing can be easily adjusted by the electric current.

TABLE 2

| | Total K/S | Degree of decolorizing (%) |
|---|---|---|
| Without electrification | 431.78 | |
| 40 mA, 7 min.processed | 84.24 | 80.5 |
| 60 mA, 7 min.processed | 35.56 | 91.8 |
| 100 mA, 7 min.processed | 24.69 | 94.3 |

Comparative Example

The same procedures as in Example 1 with the same conditions for the electrification were carried out except that ion exchanged water and a sodium sulfate solution of 10 g/L were used as the solution, with which the cloth was impregnated. The results obtained are shown in Table 3. Substantially no decolorizing occurred in the cases of ion exchanged water and a sodium sulfate solution.

TABLE 3

| | Total K/S | Degree of decolorizing (%) |
|---|---|---|
| Without electrification | 431.78 | |
| Ion exchanged water | 426.12 | 1.3 |
| Sodium sulfate solution | 430.15 | 0.4 |

EXAMPLE 4

The same procedures for electrification as in Example 1 were carried out except that a circular graphite electrode (obtained by press-molding flaky graphite at 30 Mpa, diameter: 20 mm) was used as the anode. After electrification for 7 minutes, denim cloth having a decolorized pattern of a circular shape (total K/S: 43.10, degree of decolorizing: 90.0%) was obtained.

EXAMPLE 5

The same procedures for electrification as in Example 1 were carried out except that a sodium bromide solution of 18 g/L was used as the solution, with which the cloth was impregnated. After electrification for 7 minutes, denim cloth that was decolorized only in the part, where electricity was applied, (total K/S: 63.21, degree of decolorizing: 85.4%) was obtained.

EXAMPLE 6

The same procedures for electrification as in Example 1 were carried out except that a sodium hypochlorite solution of an effective chlorine concentration of 1% (guaranteed reagent, produced by Kishida Chemical Co., Ltd.) was used as the solution, with which the cloth was impregnated. After electrification for 7 minutes, denim cloth that was considerably decolorized only in the part, where electricity was applied, was obtained. The part, where electricity was not applied, had a total K/S of 425.34 and a degree of decolorizing of 1.5%, and the part, where electricity was applied, had a total K/S of 54.9 and a degree of decolorizing of 87.3%.

EXAMPLE 7

The same procedures for electrification as in Example 1 were carried out except that electricity was applied to an area of 5×6 cm, and a sample for measuring tensile strength having a size of 5×30 cm, in which the decolorized area of 5×6 cm was included, was obtained. The tensile strength of the sample was measured according to JIS L1096 8.12. As shown in Table 4, reduction in strength was not observed even though the degree of decolorizing was increased.

TABLE 4

| Degree of decolorizing (%) | Tensile strength (N) |
|---|---|
| 0 | 1238 |
| 86.6 | 1237 |
| 91.2 | 1212 |

EXAMPLE 8

Some pieces of multifiber union cloth (according to JIS L0803) dyed with various kinds of dyes were impregnated with a sodium chloride solution of 10 g/L and were inserted between electrodes (fluorine-coated tin oxide thin film electrodes, resistance: 15 Ω, dimension: 5×12 cm). A plastic film formed with polyester (thickness: 0.1 mm, dimension: 2.5×12 cm) was inserted between the anode and the cloth, and electricity was applied with an electric current of 100 mA for 7 minutes. As a result, a part of the cloth having no film placed thereon was selectively decolorized. After application of electricity, the cloth was washed with water to remove remaining oxidized active species and then sufficiently dried. The resulting cloth was measured for the total K/S. The results obtained are shown in Table 5.

TABLE 5

| Dye | Original yarn | Total K/S | | Degree of decolorizing (%) |
|---|---|---|---|---|
| | | Without electrification | Electrification processed | |
| C. I. Direct Red 28 (Congo Red) | Cotton yarn | 221.66 | 86.93 | 60.8 |
| | Nylon filament yarn | 93.36 | 88.85 | 53.6 |
| | Worsted yarn | 191.61 | 120.39 | 37.2 |
| | Rayon filament yarn | 172.88 | 114.32 | 33.9 |
| | Raw silk | 145.50 | 74.26 | 49.0 |
| C. I. Direct Blue 200 | Cotton yarn | 240.97 | 63.09 | 73.8 |
| | Nylon filament yarn | 39.65 | 9.82 | 75.2 |
| | Worsted yarn | 50.00 | 30.30 | 39.4 |
| | Rayon filament yarn | 215.85 | 74.93 | 65.3 |
| | Raw silk | 163.22 | 59.02 | 63.8 |
| C. I. Acid Red 94 (Rose Bengal) | Nylon filament yarn | 25.68 | 16.97 | 33.9 |
| | Rayon filament yarn | 108.67 | 88.39 | 18.7 |
| | Raw silk | 48.62 | 25.27 | 48.0 |
| C. I. Disperse Orange | Nylon filament yarn | 454.73 | 325.72 | 28.3 |
| | Acetate filament yarn | 657.06 | 247.33 | 62.4 |
| | Worsted yarn | 301.45 | 213.68 | 29.1 |
| | Acrylic spun yarn | 502.73 | 442.07 | 12.1 |
| | Raw silk | 428.46 | 115.03 | 73.2 |
| | Polyester spun yarn | 433.88 | 424.94 | 2.1 |

According to the process for making a pattern of the invention, a product of dyed cloth or colored clothing, particularly a denim product, formed with a pattern of figures and letters by decolorizing can be provided, and a fine and complicated pattern can be made by the process with small blur at color contours. A product having a degree of decolorizing that is arbitrary adjusted can be easily provided by adjusting the processing time and the electric current. Furthermore, because no particular equipment or processing step is required, other various advantageous effects are also exerted, for example, patterns that support the needs of the consumers can be immediately provided.

What is claimed is:

1. A process for making a pattern on dyed fabric comprising the steps of: impregnating dyed fabric with a substance forming an oxidized active species upon electrolysis; inserting said dyed fabric between a pair of electrodes; and applying electricity to said electrodes to decompose said dye, whereby only a part of said dyed fabric where electricity is applied is selectively subjected to decolorization or discoloration.

2. The process for making a pattern on dyed fabric as claimed in claim 1, wherein said substance forming an oxidized active species upon electrolysis is at least one selected from the group consisting of a halogen-containing salt, a transition metal salt, a tertiary amine, a sulfide and a phenothiazine.

3. The process for making a pattern on dyed fabric as claimed in claim 1, wherein said substance forming an oxidized active species upon electrolysis is a halogen-containing salt.

4. The process for making a pattern on dyed fabric as claimed in claim 1, wherein said substance forming an oxidized active species upon electrolysis is a material containing a halide ion.

5. The process for making a pattern on dyed fabric as claimed in claim 1, wherein said substance forming an oxidized active species upon electrolysis is a material containing a chloride ion.

6. The process for making a pattern on dyed fabric as claimed in claim 1, wherein said substance forming an oxidized active species upon electrolysis is sodium chloride.

7. The process for making a pattern on dyed fabric as claimed in claim 1, wherein at least one of said pair of electrodes is an electrode shaped in a positive image of said pattern.

8. The process for making a pattern on dyed fabric as claimed in claim 1, wherein in the step of applying electricity to said electrodes, an electro-nonconductive film or an electro-nonconductive spacer shaped in a negative image of said pattern is inserted between said electrode and said dyed fabric.

9. A process for producing a dyed fabric having a pattern comprising the steps of: impregnating dyed fabric with a substance forming an oxidized active species upon electrolysis; inserting said dyed fabric between a pair of electrodes; and applying electricity to said electrodes to decompose said dye, whereby only a part of said dyed fabric where electricity is applied is selectively subjected to decolorization or discoloration.

10. A process for producing a colored clothing having a pattern comprising the steps of: impregnating colored clothing with a substance forming an oxidized active species upon electrolysis; inserting said colored clothing between a pair of electrodes; and applying electricity to said electrodes to decompose said dye, whereby only apart of said colored clothing where electricity is applied is selectively subjected to decolorization or discoloration.

* * * * *